United States Patent [19]

Contractor et al.

[11] 3,981,047

[45] Sept. 21, 1976

[54] APPARATUS FOR FORMING A BATT FROM STAPLE FIBERS

[75] Inventors: Rashmikant M. Contractor, Wilmington; Sang-Hak Hwang, Newark, both of Del.

[73] Assignee: E. I. Du Pont de Nemours and Company, Wilmington, Del.

[22] Filed: May 13, 1975

[21] Appl. No.: 577,056

[52] U.S. Cl. ..... 19/155

[51] Int. Cl.[2] ..... D01G 25/00

[58] Field of Search ..... 19/105, 155, 156–156.4; 156/62.2, 62.4; 425/80–83; 214/17 R, 17 A, 17 D, 17 DA

[56] References Cited

UNITED STATES PATENTS

| | | | |
|---|---|---|---|
| 2,103,769 | 12/1937 | Drill | 19/155 |
| 3,071,821 | 1/1963 | Constantine et al. | 19/155 |
| 3,177,275 | 4/1965 | Brenner | 19/156 X |
| 3,611,508 | 10/1971 | Reinhall et al. | 19/156.3 |

FOREIGN PATENTS OR APPLICATIONS

| | | | |
|---|---|---|---|
| 163,860 | 6/1921 | United Kingdom | 19/155 |
| 748,098 | 4/1956 | United Kingdom | 19/156 |

*Primary Examiner*—Dorsey Newton

[57] ABSTRACT

Apparatus for depositing staple fibers onto a conveyor belt to form a batt, including a chute feeder having an adjustable weir plate provided with a row of air jets along the bottom edge for maintaining a uniform fiber level at the exit from the chute. Fibers are supplied in an air stream from which they are separated by condenser means and fall into the chute over distributing baffles.

8 Claims, 2 Drawing Figures

APPARATUS FOR FORMING A BATT FROM STAPLE FIBERS

BACKGROUND OF THE INVENTION

This invention relates to apparatus for assembling textile fibers into loose batts, and is more particularly concerned with apparatus suitable for high speed production of batts used in preparing high quality nonwoven fabrics.

Contractor and Hwang U.S. Application Ser. No. 497,046 and Zafiroglu U.S. Pat. No. 3,797,074 disclose apparatus wherein staple fibers in batt form are fed to a toothed disperser roll which doffs the fibers into an air stream of high uniform velocity and low turbulence to form a thin stream of fibers that are then collected on a moving screen to form uniform webs suitable for further processing into nonwoven fabrics. The web-forming apparatus is capable of high speed operation when fed with uniform batts weighing many times the weight, in ounces per square yard, of the uniform webs produced. Suitable feed batts can be prepared by cross-lapping a plurality of webs formed by a carding or air-laydown machine, but production rates which can be achieved with conventional cross-lappers are limited. Apparatus has not been available for producing batts of the desired basis weight and uniformity without the use of cross-lappers.

The batt-forming apparatus of the present invention makes possible high-speed production of heavy batts of improved uniformity. Batts weighing 10 to 150 ounces per square yard can be produced without cross-lapping. Its operation, in producing batts of the required uniformity and basis weight, is characterized by lack of sensitivity to the type of fiber, e.g., denier per filament, staple length, crimp and composition. The batt-forming apparatus can be coupled to the webforming apparatus to obtain high production rates from the combination.

SUMMARY OF THE INVENTION

The present invention is an improvement in an apparatus for separating fibers from a fiber-laden transporting air stream and depositing them on a moving conveyor belt to form a batt. Deposition of the fibers on the belt is accomplished with a stationary chute. The chute has front, back and side plates which form an upright rectangular body. There is an entrance opening at the top for receiving fibers, an opening at the bottom closed by the conveyor belt, and an exit opening in the front plate for a batt of fibers to be carried out of the chute on the conveyor belt. A weir plate is positioned on the front plate with the bottom edge of the weir plate forming the top of the exit opening. A row of air jets extends along the bottom edge of the weir plate for maintaining a constant fiber level at the exit opening. These air jets are directed inwardly toward the back plate and perforations are provided in the back plate for escape of air from the chute.

The bottom portion of the back plate is preferably curved forward, in the direction of movement of the conveyor belt, to guide fibers toward the exit opening in the front plate. The chute is preferably provided with a deflector plate projecting inwardly from the front plate to guide fibers away from the front of the chute as they fall from the entrance opening in the top of the chute. Distribution of fibers in the chute can be improved by moving baffle means located beneath the entrance opening. This baffle means may be a plate which is oscillated back and forth about an axis parallel to the back plate, or it may be a plurality of baffles arranged in paddle-wheel formation which are revolved around an axis parallel to the back plate.

After the batt has left the chute, it can be compacted on the conveyor belt with a compactor plate which projects forward from the front plate of the chute at a downward incline. Further compaction can be accomplished with a similarly inclined belt mounted on rollers.

The fibers are supplied to the apparatus in a transporting air stream. They are removed from the air stream with a condenser, which may be of conventional design. When a wide chute is used to produce a wide batt, it may be desirable to feed the fibers into the chute from two or more condensers to get a better fiber distribution.

The row of air jets along the bottom edge of the weir plate acts as an air knife to maintain a constant fiber level at the chute exit by pushing and skimming off small fiber clusters. A very effective leveling action is provided. The basis weight of the batt is proportional to the bulk density of the batt times its height (the fiber level). Under suitable conditions of operation the bulk density of the batt is constant, so the air knife provides a uniform basis weight in ounces per square yard. A different basis weight can be produced by adjusting the weir plate to vary the height of the air jets, and the weir plate can comprise portions which are independently adjustable to vary the jet heights at different locations across the plate.

DETAILED DESCRIPTION

Figure 1:
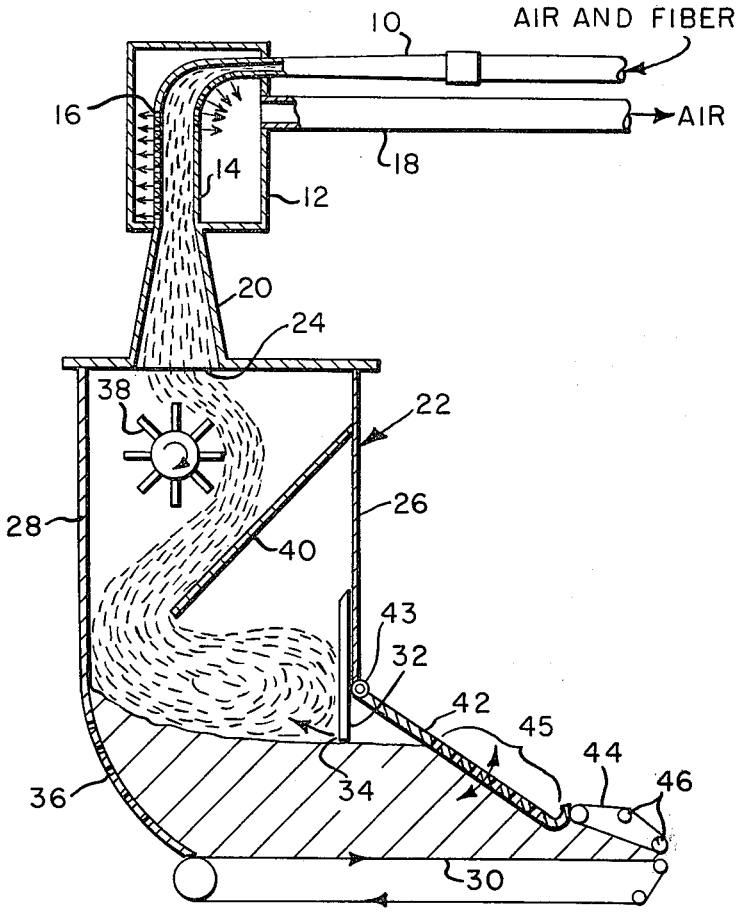
FIG. 1 is a side elevation of one embodiment of the apparatus, shown in central vertical section.

Referring to FIG. 1, the fibers are blown in a stream of air through duct 10 into condenser 12 and pass through chamber 14. Air escapes through perforations 16 and is evacuated through duct 18. The fibers fall through guide member 20 and enter chute 22 through an opening 24 in the top of the chute. The chute has an upright rectangular body constructed of front plate 26, back plate 28 and two side plates. The bottom of the chute is closed by conveyor belt 30. Back plate 28 and the two side plates extend substantially to the conveyor belt. Front plate 26 is shorter to provide an exit opening for a batt of fibers to be carried out of the chute on the conveyor belt. Weir plate 32 is positioned on the front plate with the bottom edge of the weir plate forming the top of the exit opening. A row of inwardly-directed air jets 34 (more clearly shown in FIG. 2) is provided along the bottom edge of the weir plate. The bottom portion of the back plate curves forward to guide fibers toward the exit opening, and perforations 36 are provided therein for escape of air.

The fibers entering the top of the chute are distributed by revolving baffles 38 and fall on deflector plate 40. The deflector plate projects inwardly from the front of the chute. Air from the air jets causes the fibers to swirl around and be deposited to form a batt. The conveyor belt carries the batt to the exit opening where the air jets skim off a layer of excess fibers which are blown toward the back plate and redeposited. The batt is carried through the exit opening and is compacted by oscillating action of a compactor plate 42, which is attached by hinge 43 to the base of the front plate and is perforated over the section 45 covering the batt. Further compaction is accomplished with a belt 44 which runs around a plurality of idler rollers 46.

Figure 2:
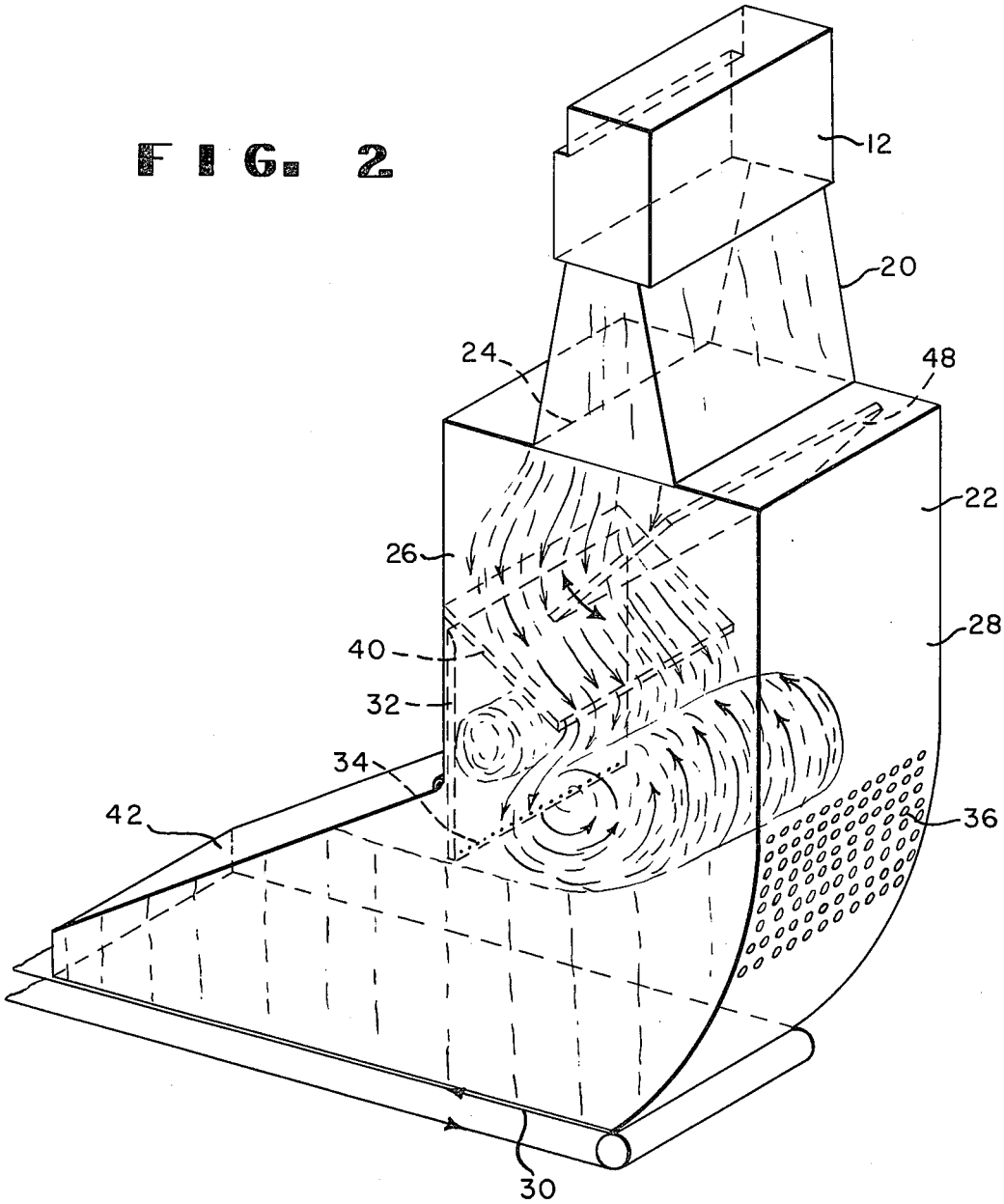
FIG. 2 is a perspective view of a similar embodiment of the apparatus.

The construction of a similar chute is shown in perspective in FIG. 2, where like parts are correspondingly numbered. In this specific embodiment an oscillating baffle 48 is used to distribute fibers entering the chute from condenser 12. A row of air jets 34 near the bottom edge of weir plate 32 is provided by drilling a series of orifices of 1/16 -inch diameter at every 0.5 inch in a horizontal line across the bottom of the weir plate. The orifices are drilled to direct a flow of air at an upward angle of 30° and are supplied with compressed air from a manifold attached to the plate (not shown). The perforations 36 in back plate 28 provide about 40 percent open area in the perforated region shown.

The perforations in the back plate serve two functions: (1) Air from the air jets 34 escapes through the perforations so that this additional amount of air does not upset the air balance at the condenser 12. (2) The fibers pushed back by the air jets (both descending fibers and fibers skimmed from the batt as it passes out of the chute) collect on the perforated plate and slide down the curved portion of the plate as additional fibers are deposited. The escaping air applies a drag on the descending fiber to reduce differences in bulk density which are caused by nonuniform fiber height and air impact.

The deflector plate 40 is used to guide fiber and air flow to the back plate so that less air is needed at the air jets for pushing back fibers. Best results are obtained when the chute is operated with the fiber level slightly below the bottom of the weir plate. Excessive escape of air through this space would cause the batt to separate below the weir plate. Such damage to the batt is avoided by the action of the deflector plate and the perforated back plate.

As shown in the following examples, the leveling action of the air jets is quite effective. Without the air jets the cross direction batt uniformity averages about 50 percent. Use of the air jets improves the uniformity to about 20 percent. Furthermore, the performance is insensitive to high throughput; the uniformity at 12 pounds per inch of width per hour (pih) is as good as that at 4 pih. When coupled to the web-forming apparatus cited at the beginning of the specification, the final webs produced have good visual aesthetics (freedom from blotches and streaks) and are suitable for producing high quality nonwoven fabrics. Further improvements in batt uniformity can be achieved by minimizing nonuniform and unsteady fiber flow from the condenser. The use of two or more condensers may be desirable, particularly with a wide chute.

Batt uniformity is determined as follows:

The cross direction batt uniformity profile is measured on samples placed under a 6.78 inch × 6.78 inch template. The chute belt is stopped and five samples are taken across the width of a 35-inch wide batt; 12 samples are taken at equal intervals from a 155-inch wide batt. The average basis weight (BW), maximum (BW) and minimum (BW) are determined for each set of samples and batt uniformity is calculated as follows:

$$\% \text{ Uniformity} = \frac{(BW)_{max.} - (BW)_{min.}}{\text{Average } (BW)} (100)$$

EXAMPLE 1

A series of runs is made with apparatus substantially as illustrated in FIG. 2 and as described previously. The chute is 35 inches wide. Polyethylene terephthalate staple fiber, ¾ inch long and 1.25 denier per fiber, is used to form batts at throughputs ranging from 4 to 12 pounds per inch per hour (pih). In each run, loosely opened clusters of fibers are fed in carrier air to a condenser which separates carrier air and drops the fibers into the chute. The weir plate is positioned at a height of 25 to 36 inches above the conveyor belt depending upon the desired batt weight, which ranged from 35 to 60 ounces per square yard. The air jets on the weir plate are used to maintain the fiber level at the desired height by pushing and skimming off small fiber clusters and creating large-scale vortices to redistribute fibers. Air is supplied to the jets at a pressure ranging from 14 to 20 pounds per square inch gage (psig.) over the throughput range of 4 to 12 pih. The amount of air used corresponds to 0.9 to 1.15 standard cubic feet per minute (SCFM) per inch width of the chute for the pressure range of 14 to 20 psig. Within this range, more air is required for the higher throughputs and for greater amounts of fiber above the level of the air jets. Best results are obtained when the fiber level at the weir plate is about 1 to 2 inches below the bottom of the plate under steady state operation.

Good batts, having values of percent uniformity from 6 to 19, are obtained over the throughput range of 4 to 12 pih. The uniformity values are independent of the pih used in the runs.

EXAMPLE 2

Apparatus similar to that of Example 1, but of approximately 4.5 times the width, is used to prepare batts of the same fibers. The width of the weir plate is 154½ inches and the height is 33⅜ to 35.5 inches from the conveyor belt to the bottom of the weir plate. Operating conditions are chosen so that the moving batt surface is approximately one inch below the weir plate. The following process conditions are used:

| | |
|---|---|
| Throughput | 5 pih |
| Conveyor belt speed | 34–37 inches/min. |
| Air pressure to jets | 5–22 psig. |

Batts are produced which weigh 45 to 50 ounces per square yard and have a percent uniformity of 18 to 24. The visual uniformity is also good.

For comparison, prior to installation of the weir plate with air jets the batt uniformity averaged 50 percent under the best conditions and was 110 percent on one occasion.

Modifications can be made in the apparatus disclosed without departing from the basic invention. Additional means can be provided for distributing fibers as they fall into the chute, e.g., a plurality of plates extending alternately from the back and front plates in cascade arrangement above the deflector plate 40. The air jets 34 can be slit-shaped instead of round, aligned to form a substantially continuous orifice slit parallel to the bottom edge of the weir plate.

We claim:

1. In an apparatus for separating staple fibers from a fiber-laden transporting air stream and depositing them on a moving conveyor belt to form a batt, a stationary chute comprising front, back and side plates forming an upright rectangular body, an entrance opening at the top for receiving fibers, an opening at the bottom closed by the conveyor belt, an exit opening in the front plate for a batt of fibers to be carried out of the chute on the conveyor belt, a weir plate positioned on the front plate with the bottom edge of the weir plate forming the top of the exit opening, a row of inwardly-directed air jets along the bottom edge of the weir plate for maintaining a constant fiber level at the exit opening, and perforations in the back plate for escape of air.

2. Apparatus as defined in claim 1 wherein the bottom portion of said back plate curves forward to guide fibers toward the exit opening in the front plate.

3. Apparatus as defined in claim 1 wherein a deflector plate projects inwardly from the front plate to guide fibers away from the front of the chute as they fall from said entrance opening.

4. Apparatus as defined in claim 3 wherein moving baffle means is located beneath said entrance opening to improve the distribution of fibers in the chute.

5. Apparatus as defined in claim 4 wherein a compactor plate projects forward from the front plate at a downward incline to compact the batt leaving said exit opening.

6. Apparatus as defined in claim 1 which includes at least one condenser for separating fibers from said transporting air stream and depositing them in the chute through said entrance opening.

7. Apparatus for forming a batt from staple fibers, comprising an upright chute for receiving the fibers and permitting them to fall through said chute towards the bottom thereof, a conveyor belt positioned at the bottom of the chute for receiving the falling fibers to form thereon a batt of said fibers and for conveying said batt out of said chute, said chute having an opening to permit the exit of said batt from said chute, a weir plate positioned across said opening with the bottom edge of the weir plate forming the top of the exit opening for said batt to exit from said chute, and air jets positioned across the bottom edge of said weir plate for directing air across the top of said batt within said chute to skim off fibers from the top of said batt within said chute, the skimmed off fibers thereby redepositing themselves and forming a more uniform batt.

8. The apparatus of claim 1 wherein the air from the air jets skim off sufficient fibers from the top of said batt that the top of said batt exiting said chute is below the bottom edge of said weir plate.

* * * * *